US007216467B2

(12) United States Patent
Pott

(10) Patent No.: US 7,216,467 B2
(45) Date of Patent: May 15, 2007

(54) COLUMN TO STRUCTURE ATTACHMENT DEVICE

(76) Inventor: Shane Pott, 730 Crescent La., Lakewood, CO (US) 80215

( * ) Notice: Subject to any disclaimer, the term of this patent is extended or adjusted under 35 U.S.C. 154(b) by 0 days.

(21) Appl. No.: 11/162,599

(22) Filed: Sep. 15, 2005

(65) Prior Publication Data

US 2006/0000160 A1 Jan. 5, 2006

Related U.S. Application Data

(62) Division of application No. 10/248,923, filed on Mar. 3, 2003, now Pat. No. 6,973,755.

(51) Int. Cl.
*E04G 23/00* (2006.01)
*E04C 5/08* (2006.01)

(52) U.S. Cl. ..... 52/745.17; 52/223.8; 52/223.1; 52/223.4; 52/223.11; 52/223.13; 52/223.14; 52/740.1

(58) Field of Classification Search ..... 52/745.17, 52/223.1, 223.4, 223.8, 223.11, 223.13, 223.14, 52/233.1, 736.1, 740.1, 737.1, 726.1–726.2, 52/732.1, 223.9, 169.9, 170, 155, 726.3, 52/726.4, 732.2, 732.3, 740.4, 740.7, 223.3, 52/724.2

See application file for complete search history.

(56) References Cited

U.S. PATENT DOCUMENTS 761,287 A * 5/1904 Cummings ..... 52/319
1,119,066 A * 12/1914 Chamberlain ..... 52/723.1
1,334,881 A * 3/1920 Bennett ..... 52/223.4
1,549,428 A * 8/1925 Barrick ..... 52/295
2,234,663 A * 3/1941 Anderegg ..... 264/228
2,664,877 A * 1/1954 McLaughlin et al. ..... 126/39 R
2,664,977 A * 1/1954 Starcevich ..... 52/301
2,781,658 A * 2/1957 Dobell ..... 52/223.13
2,941,026 A * 6/1960 Lambert ..... 174/71 R
3,086,273 A * 4/1963 Welborn ..... 264/228
3,270,471 A * 9/1966 Middendorf ..... 52/223.13
3,513,609 A * 5/1970 Lang ..... 52/223.6
3,893,271 A * 7/1975 Kotlarz ..... 52/168
4,024,688 A * 5/1977 Calini ..... 52/378
4,170,853 A * 10/1979 Kohaut ..... 52/99
4,198,798 A * 4/1980 Haydock ..... 52/699
4,275,537 A * 6/1981 Pinson ..... 52/223.8
4,407,106 A * 10/1983 Beck ..... 52/721.3
4,514,932 A * 5/1985 Janis ..... 49/50
4,624,086 A * 11/1986 MacKay ..... 52/220.8
4,718,206 A * 1/1988 Fyfe et al. ..... 52/167.8

(Continued)

*Primary Examiner*—Jeanette Chapman
(74) *Attorney, Agent, or Firm*—Roger A. Jackson

(57) ABSTRACT

A column to structure attachment device and method is disclosed for securing a support column between a base structure and a beam structural member. The device includes a structural column having a first end and a second end with a void parallel to a longitudinal axis of the column such that the void forms a communication therethrough between the first end and second end. Also included is a first end adapter element that engages the column first end and a second end adapter element that engages the column second end. In addition, an element is provided for maintaining compressive loading on the column between the first end adapter element and the second end second adapter element and is operational to maintain the compressive loading under all anticipated external loading conditions acting upon the column to structure attachment device through the base structure and the beam structural member.

5 Claims, 3 Drawing Sheets

U.S. PATENT DOCUMENTS 4,848,052 A * 7/1989 Nutzel ..... 52/223.13
5,289,626 A * 3/1994 Mochida et al. ..... 29/452
5,313,749 A * 5/1994 Conner ..... 52/223.12
5,806,266 A * 9/1998 Jennings et al. ..... 52/644
6,082,063 A * 7/2000 Shrive et al. ..... 52/223.13
6,195,949 B1 * 3/2001 Schuyler ..... 52/223.13
6,202,371 B1 * 3/2001 Natelli, Jr. ..... 52/170
6,282,859 B1 * 9/2001 Van Der Heijden ..... 52/585.1
6,557,316 B2 * 5/2003 Van Der Heijden ..... 52/585.1
6,685,399 B2 * 2/2004 Iemura et al. ..... 405/256
6,688,071 B1 * 2/2004 Evers et al. ..... 52/740.1

* cited by examiner

COLUMN TO STRUCTURE ATTACHMENT DEVICE

CROSS REFERENCE TO RELATED APPLICATIONS

This application is a divisional of U.S. patent application Ser. No. 10/248,923 filed on Mar. 3, 2003 now U.S. Pat. No. 6,973,755.

TECHNICAL FIELD

The present invention generally relates to column structural support between a base structure and a beam structural member and more particularly to structural support columns that utilize a tensioned member within the column to add rigidity and strength to the column structural assembly. The present invention of a column to structure attachment device refines this concept to completely position the tensioning member within the column to allow for the column to structure attachment device to be installed as a support between the base structure and the beam structural member without the need for a free column end to properly preload the tensioned member.

BACKGROUND OF INVENTION

It is well known in the prior art to use a tensioned member either within a column or adjacent to a beam for the purpose of adding strength to either a column or a beam structural member. Typically the tensioned member is designed to add strength in a particular axis or direction of force or as against a particular moment. As most structures have a predictable force or loading placed upon them, the use of a tensioned member can be quite beneficial in adding strength where it is required and allowing for the use of a smaller and less expensive column or beam to accommodate a specified type of loading. However, the use of a tensioned member in conjunction with a structural component such as a column or beam brings in additional considerations, such as there needs to be a method by which the tensioned member is properly stretched or pre loaded in its position being normally parallel to the lengthwise axis of the column or beam. This requires an access area or space around the endpoint of the column or beam to effectuate a tensile force upon the tension member that is typically accomplished by the use of hydraulic equipment, or a mechanical stretching means such as with bolting and threads.

Prior art examples would be U.S. Pat. No. 5,079,879 to Rodriguez that discloses a post tensioning anchorage system. Rodriquez utilizes a tension member in the form of a cable that is pulled or pretensioned at the end of the cable and once the proper tension is set the tension member is held in place by the use of a wedge lock arrangement that secures the cable in a pre stressed situation being designed for the situation wherein there is a poured concrete structure that has a free end access for the purpose of prestressing the tension member. Another example would be in U.S. Pat. No. 4,916,874 to McCoy et al. that discloses an apparatus for reinforcing a concrete brick wall wherein the tension in mechanism is positioned on the top edge of the block wall for the purpose of stretching or pre loading the tension member that is within the brick wall. Again, McCoy et al. requires free access to the top edge of the brick wall to properly set the tension required for the tension member within the brick wall. Similarly, U.S. Pat. No. 1,549,428 to Barrick discloses a cantilevered support column structure in the form of a lamp standard utilizes a tension member within the column, however, again requiring an end access to the column for the purpose of prestressing the tension member. Barrick also states in the disclosure that the use of the tie rod tension members is optional for achieving the required strength, thus Barrick does not view the use of the tension member as mandatory in the lamp standard design which would not really be considered a structural component in any case. In another type of application U.S. Pat. No. 4,624,086 to MacKay discloses a cast-in-place sleeve insert for forming an aperture through a poured concrete wall, although the tension member is used for different purpose, which is to secure the end cap plates onto the sleeve ends for the prevention of poured concrete migrating within the sleeve. However, there is still the same requirement of having to have access to an open end of the sleeve to properly stretch the tension member for the purpose of drawing the end cap plates securely against the sleeve for a concrete tight seal and to secure the sleeve against the concrete form wall. Alternatively, there are special use devices in the prior art such as U.S. Pat. No. 5,313,749 to Conner that disclose the use of a tension member on a conventional structural steel I beam or girder, wherein a portion of the beam axial length is prestressed with the tension member such that the tension member can be stretched inside of the beam ends, however, Conner does not apply to the use of the perpendicular mounting attachment of the beam to another structural member as Conner merely pre induces a moment in the beam to counteract the loads placed on the beam when is incorporated into a structure What is needed is a column to structure attachment device that utilizes the well recognized benefits of using prestressed tension members in conjunction with columns and beams in a structural context that add strength and rigidity to the column and beam without increasing the size, expense, or weight of the column or beam structural component. The aforementioned prior art typically focuses upon utilizing the benefits of a pre stressed attention member for a segment or portion of the column or beam and do not utilize the benefit of using a pre stressed tension member for not only the column or beam member but also the end cap portion that effectuates the perpendicular attachment interface between the column or beam and an adjoining structural component. The present invention fulfills this need by providing a column structural support between a base structure and a beam structural member and more particularly to structural support columns that utilize a tensioned member within the column to add rigidity to the column structure that includes the end cap portions. The present invention of a column to structure attachment device refines this concept to completely position the tensioning member within the column to allow for the column to structure attachment device to be installed as a support between the base structure and the beam structural member without the need for a free column end to properly preload the tensioned member thus making installation much simpler.

SUMMARY OF INVENTION

It is an object of the present invention to provide a column to structure attachment device that secures a support column between a base structure and a beam structural member.

It is a further object of the present invention to create a compressive preload along a longitudinal axis of the support column between a first and a second end adapter and to maintain the compressive preload under all anticipated external loading conditions acting upon the column to structure attachment device through the base structure and the beam structural member.

It is yet another object of the present invention is to provide a strong yet lightweight column to structure attachment device that is relatively easy to assemble.

It is still yet another object of the present invention to provide a method of installing the column to structure attachment device to secure a support column between a base structure and a beam structural member.

It further yet another object of the present invention to substantially evenly distribute on the column the external loading from the conditions acting upon the column to structure attachment device through the base structure and the beam structural member.

A column to structure attachment device and method is disclosed for securing a support column between a base structure and a beam structural member. Broadly, the present invention includes a structural column element that includes a first end and a second end with a longitudinal axis extending between the first end and the second end, the column also includes a void parallel to the longitudinal axis such that the void forms a communication therethrough between the first end of the column and the second end of the column. The present invention also includes a first end adapter element that engages the column first end; the first end adapter element includes a first end adapter element portion that is within the void and a first end adapter element extension portion that projects beyond the column first end in an axis perpendicular to the column longitudinal axis. Also included is a second end adapter element that engages the column second end, the second end adapter element includes a second end adapter element portion that is within the void and a second end adapter element extension portion that projects beyond the column second end in an axis perpendicular to the column longitudinal axis. Finally, included is a means for maintaining symmetric compressive loading on the column between the first end adapter element portion and the second end second adapter element portion, the means for maintaining symmetric compressive loading is positioned within the void and is operational to maintain the column compressive loading under all anticipated external loading conditions acting upon the column to structure attachment device through the base structure and the beam structural member.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
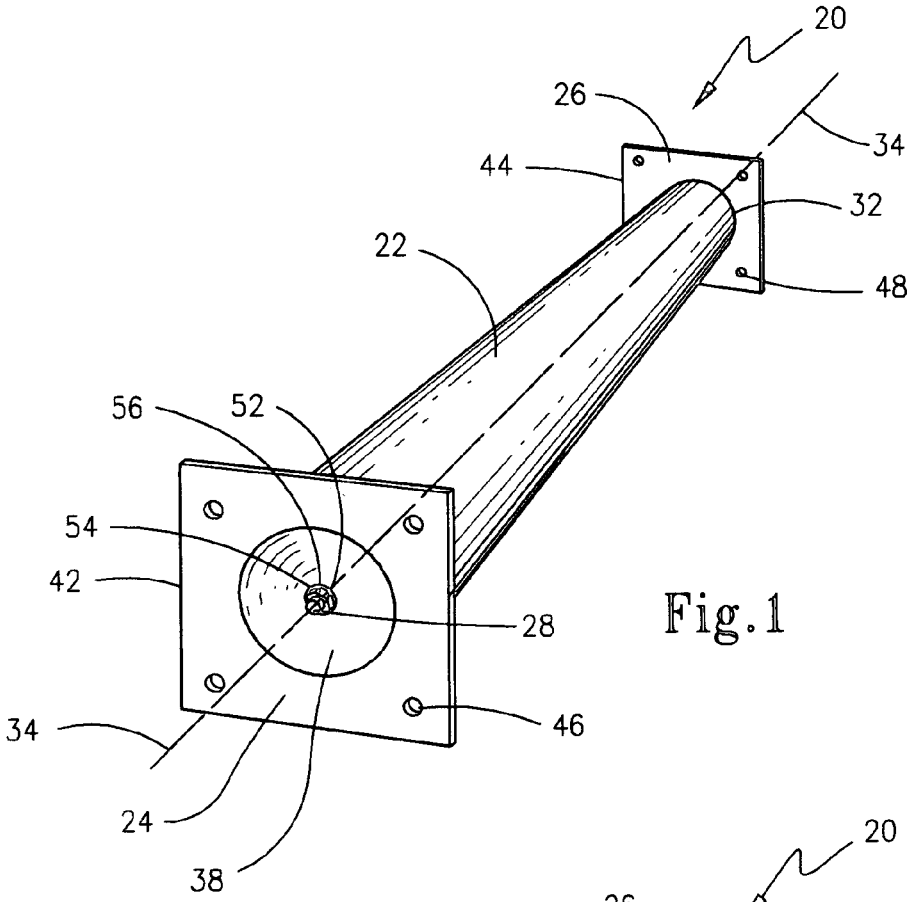
FIG. 1 shows a perspective view from the first side of an exemplary embodiment of the present invention of a column to structure attachment device assembly.
Figure 2:
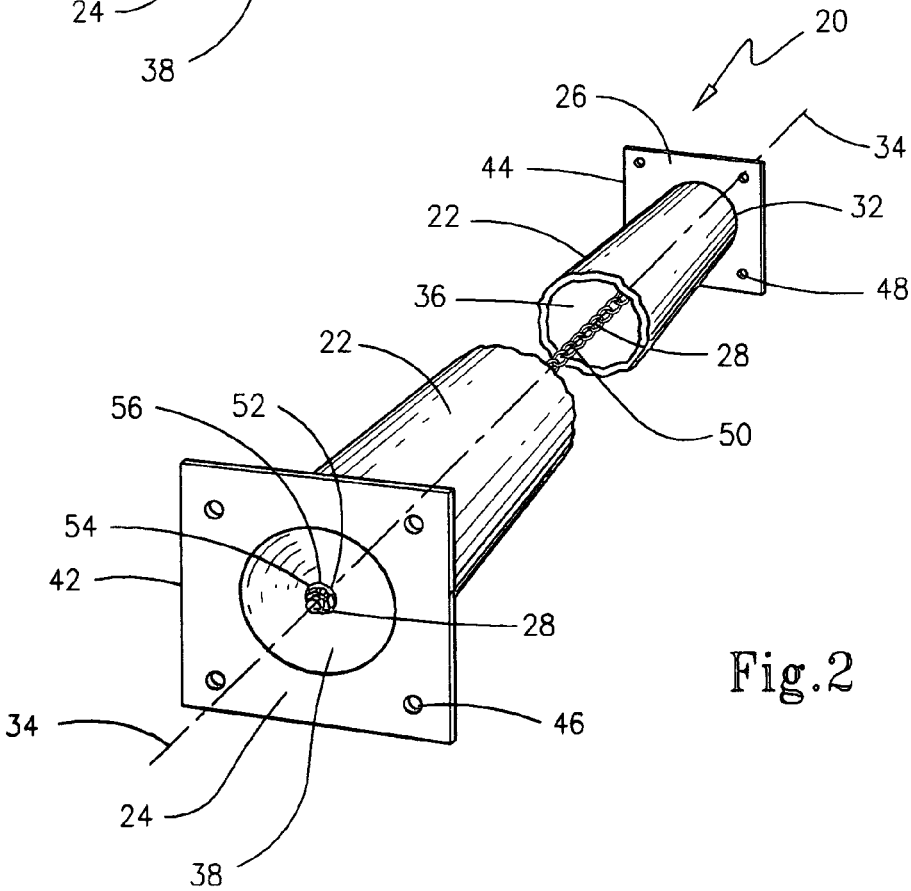
FIG. 2 shows a perspective view from the first side of an exemplary embodiment of the present invention of a column to structure attachment device with a column break out section showing a portion of the means for maintaining symmetric compressive loading.

20 Column to Structure Attachment Device Assembly
22 Structural Column
24 First end adapter element
25 First end adapter element thickness
26 Second end adapter element
27 Second end adapter element thickness
28 Means for maintaining symmetric compressive loading
30 Structural column first end
32 Structural column second end
34 Structural column longitudinal axis
36 Structural column void
38 First end adapter element portion in void
40 Second end adapter element portion in void
42 First end adapter element extension
44 Second end adapter element extension
46 First end adapter element aperture
48 Second end adapter element aperture
49 Flexible tension member retention element
50 Flexible tension member
51 Tension device
52 Eyebolt
54 Washer
56 Nut
57 First end adapter element smooth plane surface
58 Beam structural member
59 Second end adapter element smooth plane surface
60 Lag bolt
62 Beam bolt assembly
64 Base structure anchor bolt assembly
66 Base structure wedge anchor bolt assembly
68 Base structure
69 Distance between base structure and beam structural member
70 Lift force
72 Sway force
74 Dead load

DETAILED DESCRIPTION

A column to structure attachment device and method is disclosed for securing a support column between a base structure and a beam structural member. Broadly, the present invention includes a structural column element that includes a first end and a second end with a longitudinal axis extending between the first end and the second end, the column also includes a void parallel to the longitudinal axis such that the void forms a communication therethrough between the first end of the column and the second end of the column. The present invention also includes a first end adapter element that engages the column first end; the first end adapter element also includes a first end adapter element portion that is within the void and a first end adapter element extension portion that projects beyond the column first end in an axis perpendicular to the column longitudinal axis. Also included is a second end adapter element that engages the column second end, the second end adapter element includes a second end adapter element portion that is within the void and a second end adapter element extension portion that projects beyond the column second end in an axis perpendicular to the column longitudinal axis. Finally, included is a means for maintaining symmetric compressive loading on the column between the first end adapter element portion and the second end second adapter element portion, the means for maintaining symmetric compressive loading is positioned within the void and is operational to maintain the column compressive loading under all anticipated external loading conditions acting upon the column to structure attachment device through the base structure and the beam structural member.

With initial reference to FIGS. 1 through 4, the present invention of the column to structure attachment device 20 for securing a support column between a base structure and a beam structural member is shown. Starting with a structural column element 22 that includes a structural column first end 30 and a structural column second end 32 with a longitudinal axis 34 extending between the first end 30 and the second end 32. The column 22 also includes a void 36 that is parallel to the longitudinal axis 34 such that the void 36 forms a communication therethrough between the column first end 30 and column second end 32. Also included is a first end adapter element 24 that engages the column first end 30, the first end adapter element 24 includes a first end adapter element portion 38 that is within the void 36 and a first end adapter element extension portion 42 that projects beyond the column first end 30 in an axis perpendicular to the longitudinal axis 34. The column to structure attachment device 20 also includes a second end adapter element 26 that engages the column second end 32, the second end adapter element 26 includes a second end adapter element portion 40 that is within the void 36 and a second end adapter element extension portion 44 that projects beyond the column second end 32 in an axis perpendicular to the longitudinal axis 34. Finally, the column to structure attachment device 20 includes a means 28 for maintaining symmetric compressive loading on the column 22 between the first end adapter element portion 38 and the second end second adapter element portion 40. The means 28 for maintaining symmetric compressive loading is positioned within the void 36 and is operational to maintain the compressive loading under all of the anticipated external loading conditions acting upon the column to structure attachment device 20 through the base structure and the beam structural member.

The materials of construction for the column 22 is preferably fiberglass, however, composite plastics, or reinforced plastics are acceptable materials as long as the strength requirements are met based upon all of the anticipated external loading conditions acting upon the column to structure attachment device 20 through the base structure and the beam structural member. Alternatively, the column 22 could be constructed of structural steel or carbon steel, another alternative could also be formed concrete, again any of the alternative materials would be acceptable as long as the aforementioned strength requirements are met for all of the alternative materials listed. The configuration for the column 22 is preferably round in cross-section; however any number of other crossectional shapes would be acceptable such as square, rectangular, elliptical, combining to semicircular sections with straight sections in between semicircular sections, or any other crossectional configurations that would meet the requirements for strength as previously mentioned would also be acceptable. The typical, as supplied length of the column 22 is twelve (12) feet, however, a column 22 length longer or shorter could be supplied as required. Moving on to the first end adapter element 24 and the second end adapter 26 element the preferred materials of construction are structural steel or carbon steel, however, fiberglass, composite plastics, or a reinforced plastic material would be acceptable as long as the strength requirements are met based upon all of the anticipated external loading conditions acting upon the column to structure attachment device 20 through the base structure and the beam structural member. The first end adapter element 24 and the second end adapter 26 element when constructed of the preferred materials of construction which are structural steel or carbon steel, both the first end adapter element 24 and the second end adapter 26 are preferably, three-thirty seconds (3/32") of an inch thick each or what is commonly known in the art as twelve (12) gage.

Figure 6:
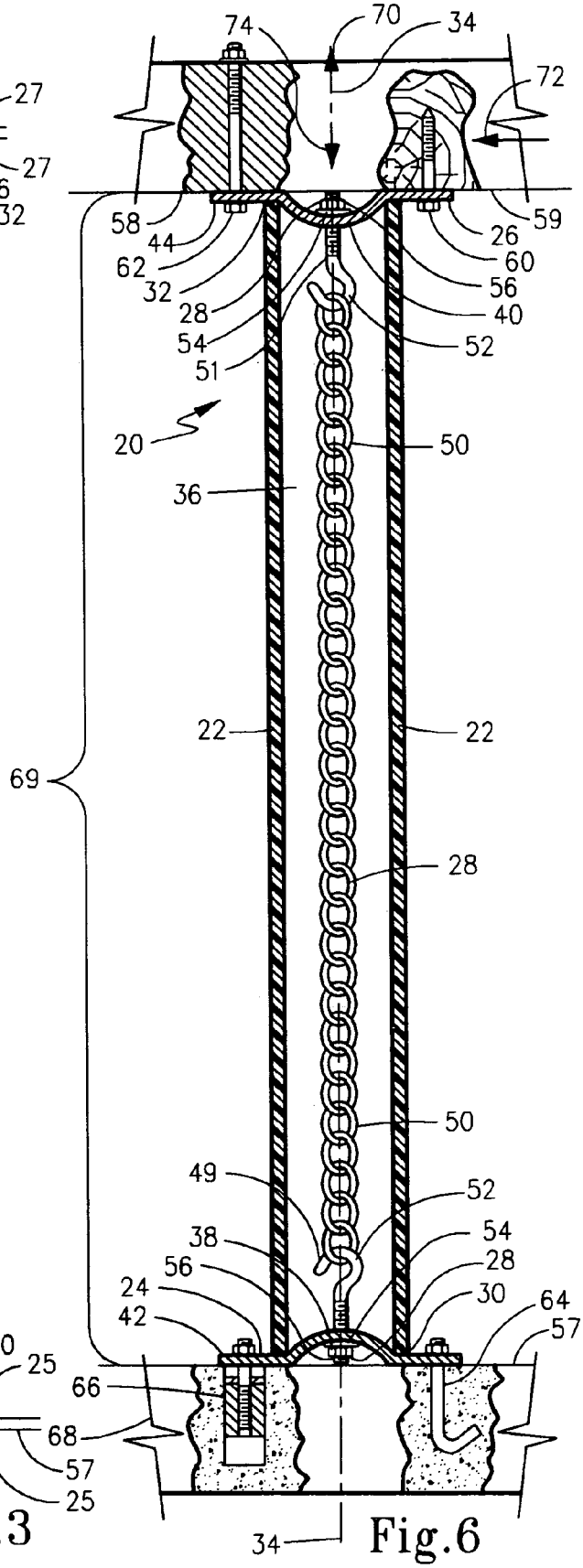
FIG. 6 shows a side cross section view of an exemplary embodiment of the present invention of a column to structure attachment device assembly with the base structure and the beam structural member shown in place.
Figure 4:
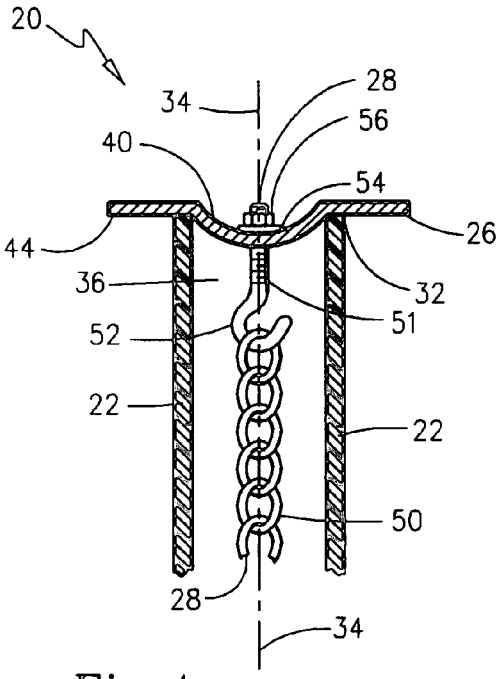
FIG. 4 shows an expanded side cross section view of an exemplary embodiment of the present invention of a column to structure attachment device assembly, in particular the interface between the column end, the second end adapter element, and the means for maintaining symmetric compressive loading.

Returning to the first end adapter element 24, and more particularly the first end adapter element portion 38 which is configured as a concave depression as viewed from the non column 22 side, the first end adapter element portion 38 is operational to provide a flat plane surface 57 to secure the first end adapter element 24 and more particularly the first end adapter element extension portion 42 to the base structure 68 as shown in FIG. 6. Focusing upon the first end adapter element extension portion 42 that has an aperture 46 for a fastener which is preferably a wedge bolt 66 that is typically supplied as a one-half (½) inch in diameter in size, being to secure the first end adapter element extension portion 42 and hence the first end adapter element 24 and column 22 to the base structure 68. Wherein other sizes could be used as needed for strength as described in FIG. 6. Alternatively, an anchor bolt 64 that is adequate for strength could be used to secure the first end adapter element extension portion 42 and hence the first end adapter element 24 and column 22 to the base structure 68. This is one of the principal advantages of the present invention of the column to structure attachment device 20 is that it can be installed as a "slide in" into an existing structure, such as between the base structure 68 and beam structural member 58 without the need for access to either end of the column to structure attachment device 20 for completion of the assembly of the column 22, the first end adapter 24, the second end adapter 26, and the means 28 for maintaining symmetric compressive loading on the column 22 once it is installed into the existing structure. Moving next to the second end adapter element 26, and more particularly the second end adapter element portion 40 which is configured as a concave depression as viewed from the non column 22 side, the second end adapter element portion 40 is operational to provide a flat plane surface 59 to secure the second end adapter element 26 and more particularly the second end adapter element extension portion 44 to the beam structural member 58 as shown in FIG. 6. Again, focusing upon the second end adapter element extension portion 44 that has an aperture 48 for a fastener which is preferably a lag bolt 60 with a typical size being one-quarter (¼) inch in diameter by four (4) inches long, with other sizes being acceptable for the anticipated loads on the column to structure attachment device 20 as further defined in FIG. 6. Alternatively, a beam bolt assembly 62 could be used to secure the second end adapter element extension portion 44 and hence the second end adapter element 26 and column 22 to the beam structural member 58. This again is one of the principal advantages of the present invention of the column to structure attachment device 20 is that it can be installed as a "slide in" into an existing structure, such as between the base structure 68 beam structural member 58 as shown in FIG. 6, without the need for access to the end of the column to structure attachment device 20 for assembling the column 22, the first end adapter 24, the second end adapter 26, and the means 28 for maintaining symmetric compressive loading on the column 22 when mounted into the existing structure.

Figure 5:
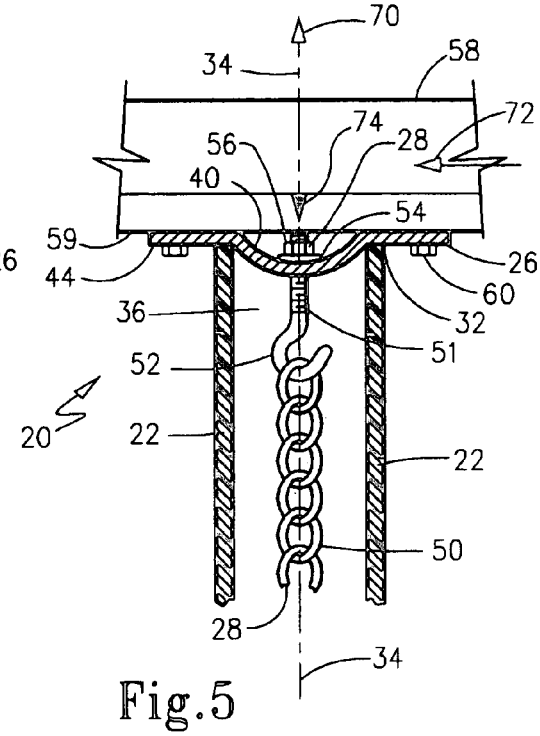
FIG. 5 shows an expanded side cross section view of an exemplary embodiment of the present invention of a column to structure attachment device assembly, in particular the interface between the column end, the second end adapter element, and the means for maintaining symmetric compressive loading with the beam structural member in place.
Figure 7:
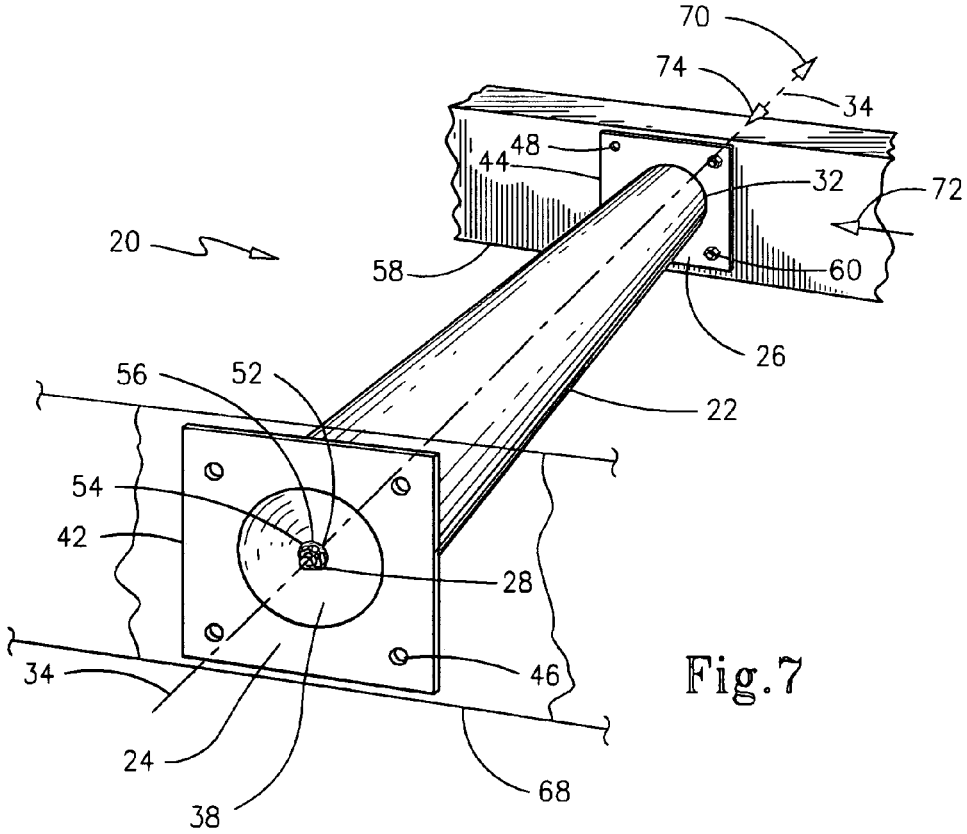
FIG. 7 shows a perspective view from the first side of an exemplary embodiment of the present invention of a column to structure attachment device assembly with the base structure and the beam structural member shown in place.

The means 28 for maintaining symmetric compressive loading on the column 22 between the first end adapter element portion 38 and the second end second adapter element portion 40 is constructed of three basic elements, being a flexible tension member 50, a flexible tension member retention element 49, and a tension device 51 for creating tension in the flexible tension member 50 to maintain the compressive loading on the column 22 between the first end adapter element 24 or more specifically the first end adapter element portion 38 and the second end adapter element 26 or more specifically the second end second adapter element portion 40. The first element of a flexible tension member 50 that is preferably constructed of a multilink chain that is positioned within the column void 36 and is normally supplied in a length of twelve (12) feet, with longer or shorter lengths of multilink chain being acceptable as required. Also, the multilink chain is normally supplied in a three-eights (3/8) of an inch in link diameter in size, with other sizes being used as required for maintaining the symmetric compressive loading on the column 22 that the external loading conditions would require. As an alternative, the flexible tension member 50 could be constructed of a rod with a threaded end, a cable, or a roller chain. The materials of construction for the flexible tension member 50 would normally be a carbon steel that has a corrosion resistant outer coating. The major function of the flexible tension member 50 is to withstand the tensile load it experiences in placing the column 22 under a compressive load between the first end adapter element portion 38 and the second end second adapter element portion 40, thus tensile strength with an appropriate safety factor are the design criteria for the flexible tension member 50 whichever configuration or material the flexible tension member 50 is constructed of. The amount of tension placed upon the flexible tension member 50 is determined by the second and third elements of the means 28 for maintaining symmetric compressive loading on the column 22 that are subsequently described. The second element of the means 28 for maintaining symmetric compressive loading on the column 22 is a flexible tension member retention element 49 which normally secures the flexible tension member 50 to the first end adapter element 24 and more specifically the first end adapter element portion 38 that is positioned within the column void 36. Preferably, the flexible tension member retention element 49 is accomplished by use of a bolt 52 and a nut 56 assembly and optionally adding a washer 54 that is positioned between the nut 56 and the first end adapter element portion 38. However, the flexible tension member retention element 49 can be accomplished by a number of alternative means, including a permanent type of attachment such as welding, or a slot, or a dovetail type of attachment, or any other suitable attachment that would have the required strength for the compressive tensile loading as previously described. Additionally, the flexible tension member retention element 49 which preferably includes the eye bolt 52 and the nut 56 and also optionally a washer 54, the flexible tension member retention element 49 can be truncated as shown in FIG. 6 to have the flexible tension member retention element 49 be positioned within the first end adapter element portion 38 which is within the column void 36. The purpose of this is to eliminate the protrusion of the flexible tension member retention element 49 for maintaining the compressive loading attachment being the flexible tension member 50 attachment to the fist end adapter element portion 38 to have a smooth plane surface 57 for the first end adapter 24 to be set against the base structure 68. The third element of the means 28 for maintaining symmetric compressive loading on the column 22 is a tension device 51 for creating tension in the flexible tension member 50 to maintain the compressive loading in the column 22. Preferably, the tension device 51 is accomplished by the use of a nut 56 that is utilized in conjunction with an eyebolt 52 and optionally a washer 54 to control the amount of prestress in the flexible tension member 50 by controlling the amount of torque placed upon the nut 56. The typical size of the nut 56 that is utilized in conjunction with an eyebolt 52 and optionally a washer 54 is one-half (½) inch in diameter by four (4) inches in length, although other sizes would be acceptable as required for strength. Alternatively, when a rod is used for the flexible tension member 50, the nut 56 and optionally the washer 54 are used for the tension device 51. This amount of torque in foot pounds is determined by what is required by conventional engineering calculations for the amount of tensile prestress force desired on the means 28 for maintaining compressive loading or more particularly on the flexible tension member 50, based upon the forces acting upon the column to structure attachment device assembly 20, being the combination of the lift force 70, the sway force 72, and the dead load 74, as shown in FIGS. 5, 6, and 7, and more fully described in the method of use. However, in returning to FIGS. 1 through 4, the important thing to focus on is the resultant tensile prestress force placed upon the flexible tension member 50, thus if another method were used that did not include the aforementioned eyebolt 52 and nut 56, such as in the case of using a cable for the flexible tension member 50, there would need to be a way to measure the correct prestress tensile force placed on the cable before it is secured in place against the second end adapter element 26 or more particularly the second end adapter element portion 40. The conversion of the nut 56 tightening torque to a prestress tensile force is well known in the art which would be used for the purpose of effectuating a desired amount of tensile prestress force placed upon the flexible tension member 50 from a given torque value.

In looking at FIGS. 5 and 6 the means 28 for maintaining compressive loading and more particularly the tension device 51 which includes the eye bolt 52 and the nut 56 and also optionally a washer 54, the tension device 51 can be truncated as shown to have the tension device 51 be positioned within the second end adapter element portion 40 which is within the column void 36. The purpose of this is to eliminate the protrusion of the tension device 51 for maintaining the compressive loading attachment being specifically the flexible tension member 50 to the second end adapter element portion 40 so the second end adapter 26 will have a smooth plane surface 59 for the second end adapter 26 to be set against the beam structural member 58. Returning to the means 28 for maintaining compressive loading on the second end adapter element 26 to create an axial compressive loading on the column 22 between the first end adapter element 24 and the second end adapter element 26 the amount of tensile prestress tension which is the axial compressive loading on the column 22 is determined by the anticipated external loading conditions acting upon the column to structure attachment device 20 through the base structure 68 and the beam structural member 58. The purpose here is to create tensile prestress in the means 28 for maintaining compressive loading to effectively clamp the first end adapter element 24 and the second end adapter element 26 in an axial manner against the respective column 22 first end 30 and second end 32 to a level higher than the column to structure attachment device 20 would experience from anticipated loading in the structure that is supported. This is similar to what is known in the art as pre loading a fastener to preclude failure during actual use load conditions. This would include three basic types of loads, the first of which what is termed the dead load 74 being the axial compressive load from the weight of the structure supported by the column to structure attachment device 20, the second load type which would be in a direction opposite of the dead load being an uplift load 70 that is typically from hurricane or high wind loads that the structure would impose upon the column to structure attachment device 20, and the third load would-be oriented perpendicularly to the aforementioned dead load 74 and uplift load 70, which is termed the sway force or load 72 which also typically from hurricane or high wind loads. Seismic loads can also be a consideration depending upon the location of the structure for adding to the three aforementioned loads. Because of these three loads the amount of prestress in the means 28 for maintaining compressive loading is important with the amount of prestress being set as follows. Note that these three anticipated loads on the column to structure attachment device 20 being the dead load 74, the uplift load 70, and the sway force or load 72 can all act in combination to produce a composite loading on the column to structure attachment device 20 that would determine the amount of the tensile prestress that is created by the tension device 51 by the known combination or multiple load calculations methods in the structural arts. Thus, in general the tensile prestress that is created by the means 28 for maintaining compressive loading upon the column to structure attachment device 20 is greater by an accepted safety factor margin than the combined external loads of the dead load 74, the uplift load 70, and the sway force or load 72 so that the column to structure attachment device 20 will not structurally fail under the anticipated load conditions imposed by the aforementioned combined external loads.

Method of Use

Figure 3:
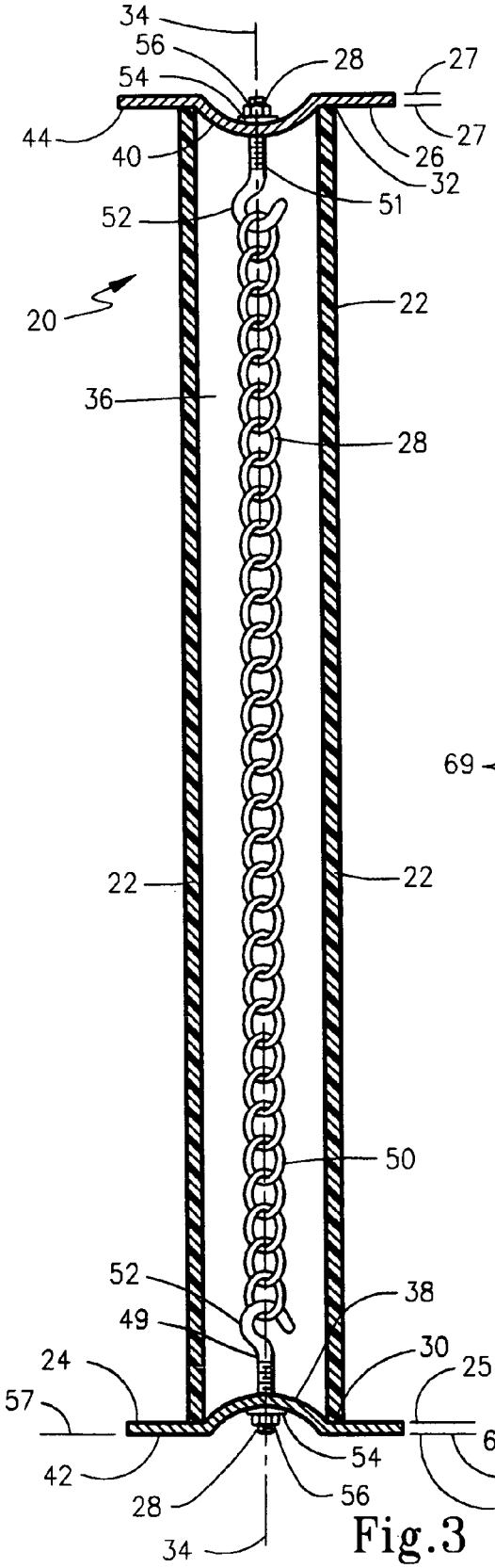
FIG. 3 shows a side cross section view of an exemplary embodiment of the present invention of a column to structure attachment device assembly.

A method of use is disclosed and shown in FIGS. 3, 6, and 7 for installing an exemplary embodiment of the column to structure attachment device 20 for the purpose of securing a support column between a base structure 68 and a beam structural member 58. As a first step to provide the column to structure attachment device 20 which broadly includes a structural support column 22 that has a first end 30 and a second end 32 with an axial length therebetween, the column 22 also includes a void 36 that communicates between the column first end 30 and the column second end 32 therethrough. Also included is a first end adapter element 24 that has a first end adapter element thickness 25 that adds to the column total axial length, in addition a second end adapter element 26 is provided with a second end adapter element thickness 27 that again adds to the total column axial length. Subsequently, provided is a means 28 for maintaining symmetric compressive loading on the column 22 between the first end adapter element 24 and the second end adapter element 26.

As a first functional step for installing the column to structure attachment device 20 the column 22 needs to be truncated to an axial length resulting in a dimension that is equal to the distance 69 between the base and the beam structural member less the first end adapter element thickness 25 and less the second end adapter element thickness 27. This truncation of the column 22 can be accomplished a number of different ways principally depending upon the material of construction for the column 22. Preferably, if the column 22 is constructed of fiberglass or other similar material the column 22 can be cut to its desired axial length in other words truncating the length of the column 22 by use of a basic saw, other materials such as structural steel or carbon steel may dictate the use of a conventional metal cutting torch, a pipe type cutter, or any other applicable method that would be appropriate to cut the column 22 to the desired axial length. It is important to note that whatever method is used to cut the column 22 to the desired length that the finished cut surface be perpendicular to a longitudinal axis 34 of the column 22 itself and that the cut surface be smooth and flat. A next step is to attach the means 28 for maintaining compressive loading to the first end adapter element 24, in the exemplary embodiment of the column to structure attachment device 20 this can be accomplished by use of the bolt 52 and nut 56 assembly and optionally adding the washer 54. However, any number of means can used for this attachment, including a permanent type attachment such as welding or slot or dovetail type of attachment or any other suitable attachment that would have the required strength for the compressive tensile loading. Note that a further step of positioning the first end adapter element portion 38 being the concave portion 38 is to be positioned to be within the column 22 void 36 meaning that the means 28 for maintaining compressive loading is to extend from the convex side 38 of the first end adapter element 24. Returning to the means 28 for maintaining compressive loading and more particularly to the eye bolt 52 and the nut 56 a further step can be added that includes truncating the means 28 for maintaining compressive loading attachment to the first end adapter 24 to be within the void 36. The purpose of this is to eliminate the protrusion of the means 28 for maintaining compressive loading attachment to the first end adapter 24 to have a smooth plane surface 57 for the first end adapter 24 to be set against the base structural 68.

Subsequently a further step is completed of feeding the means 28 for maintaining compressive loading through the column 22 void 36 from the column first end 30 to the column second end 32 therethrough, preferably the flexible tension member portion 50 of the means 28 for maintaining compressive loading is a multilink chain. At this point the means 28 for maintaining compressive loading through the column 22 is extended through the column void 36 and extending beyond the column second end 32. Once this is done and further step is to engage the first end adapter element 24 onto the column first end 30 again noting that the first end adapter element portion 38 being the concave portion 38 is to be positioned to be within the column 22 void 36 meaning that the means 28 for maintaining compressive loading is to extend from the convex side 38 of the first end adapter element 24 residing within the column 22 void 36. Moving to the column 22 second end 32 where the means 28 for maintaining compressive loading is extended from the column 22 second end 32, the second end adapter element 26 is attached to the means 28 for maintaining compressive loading. The positioning of the second end adapter element 26 in relation to both the second end 32 and the means 28 for maintaining compressive loading is such that the concave portion 40 is to be positioned to be engaged within the column 22 void 36 on the column 22 second end 32. At this point both the first end adapter element 24 and the second end adapter element 26 are respectively positioned on the column 22 first end 30 and the column 22 second end 32.

The next step is to secure the means 28 for maintaining compressive loading on the second end adapter element 26 to create an axial compressive loading on the column 22 between the first end adapter element 24 and the second end adapter element 26. The purpose here is to create tensile prestress in the means 28 for maintaining compressive loading to effectively clamp the first end adapter element 24 and the second end adapter element 26 in an axial manner against the respective column 22 first end 30 and second end 32 to a level higher than the column to structure attachment device 20 would experience from anticipated loading in the structure that is supported. This would include three basic types of loads, the first of which what is termed the dead load 74 being the axial compressive load or weight from the structure supported by the column to structure attachment device 20, the second load type which would be in a direction opposite of the dead load being an uplift load 70 typically from wind or hurricane conditions that the structure would impose upon the column to structure attachment device 20, and the third load would-be oriented perpendicularly to the aforementioned first and second loading types which is termed the sway force or load 72, also from wind. Because of these three loads the amount of prestress in the means 28 for maintaining compressive loading is important with the amount of prestress being set as follows. In the exemplary embodiment of the column to structure attachment device 20 a nut 56 is utilized in conjunction with the eyebolt 52 to control the amount of prestress in the means 28 for maintaining compressive loading by controlling the amount of torque placed upon the nut 56 on the second end adapter element 26. This amount of torque in foot pounds is determined by what is required by conventional engineering calculations for the amount of tensile prestress force desired on the means 28 for maintaining compressive loading or more particularly on the flexible tension member 50, based upon the forces acting upon the column to structure attachment device assembly 20, being the combination of the lift force 70, the sway force 72, and the dead load 74. However, the important thing to focus on is the resultant prestress force placed upon the means 28 for maintaining compressive loading, thus if another method used that did not include the aforementioned eyebolt 52 and nut 56, such as in the case of using a cable that there would need to be a way to measure the correct prestress force placed on the cable before it is secured in place against the second end adapter element 26. The conversion of the nut 56 tightening torque to a prestress force is well known in the art which would be used for the purpose of effectuating a desired amount of tensile prestress force placed upon the means 28 for maintaining compressive loading from a given torque value. Returning to the means 28 for maintaining compressive loading and more particularly to the eye bolt 52 and the nut 56 a further step can be added that includes truncating the means 28 for maintaining compressive loading attachment to the second end adapter 26 to be within the void 36. The purpose of this is to eliminate the protrusion of the means 28 for maintaining compressive loading attachment to the second end adapter 26 to have a smooth plane surface 59 for the second end adapter 26 to be set against the beam structural member 58.

Continuing on to a further step the column to structure attachment device 20 is then set or positioned such that the column to structure attachment device 20 that includes the column 22, the first end adapter 24, the second end adapter 26, and the means 28 for maintaining symmetric compressive loading is placed or slide in between the base structure 68 and the beam structural member 58. One of the principal benefits of the column to structure attachment device 20 is that the device 20 can be placed between the base structure 68 and the beam structural member 58 without the need for any clearance required on either end of the device 20. This means that the base structure 68 and the beam structural member 58 can be in their permanent position without having to be moved with the device 20 being permanently installed. The next steps are to attach the first end adapter 24 to the base structure 68 and to attach the second end adapter 26 to the beam structural member 58. These two attachments can be accomplished by a number of methods, preferably the use of either expansion bolts 66 or anchor bolts 64 are used for attaching the first end adapter 24 through an aperture 46 that is in the first end element adapter extension 42 to the base structure 68, and for attaching the second end adapter 26 through an aperture 48 that is in the second end element adapter extension 44 to the beam structural member 58 is desirably accomplished by the use of lag bolts 60 or a conventional bolt assembly 62. However, any acceptable method for at the aforementioned attachments would be acceptable as long as the loading requirements were met that are imposed upon the structure.

CONCLUSION

Accordingly, the present invention of a column to structure attachment device has been described with some degree of particularity directed to the embodiments of the present invention. It should be appreciated, though, that the present invention is defined by the following claims construed in light of the prior art so modifications the changes may be made to the exemplary embodiments of the present invention without departing from the inventive concepts contained therein.

What is claimed is:

1. A method for installing a column to structure attachment device for securing a support column between a base structure and a beam structural member, comprising the steps of:

(a) providing a structural support column including a first end and a second end with an axial length therebetween, said column also including a void that communicates between said column first end and said column second end therethrough, a first end adapter element with a first end adapter element thickness that adds to said column axial length, a second end adapter element with a second end adapter element thickness that adds to said column axial length, and a means for maintaining symmetric compressive loading on said column between said first end adapter element and said second end adapter element;

(b) truncating said column axial length to a dimension equal to the distance between the base and the beam structural member less said first end adapter element thickness and less said second end adapter element thickness;

(c) attaching said means for maintaining compressive loading to said first end adapter element;

(d) feeding said means for maintaining compressive loading through said column void from said column first end to said column second end therethrough;

(e) engaging said first end adapter element on said column first end;

(f) attaching said means for maintaining compressive loading to said second end adapter element;

(g) engaging said second end adapter element on said column second end;

(h) securing said means for maintaining compressive loading on said second end adapter element to create an axial compressive loading on said column between said first end adapter element and said second end adapter element;

(i) setting said column to structure attachment device that includes said column, said first end adapter, said second end adapter, and said means for maintaining symmetric compressive loading in place between the base and the beam structural member;

(j) attaching said first end adapter to the base structure; and (k) attaching said second end adapter to the beam structural member.

2. A method for installing a column to structure attachment device according to claim 1 further including a step of positioning a first end adapter element portion to be within said void.

3. A method for installing a column to structure attachment device according to claim 2 wherein said step of attaching said means for maintaining compressive loading to said first end adapter element further includes truncating said means for maintaining compressive loading attachment to said first end adapter to be within said void.

4. A method for installing a column to structure attachment device according to claim 1 further including a step of positioning a second end adapter element portion to be within said void.

5. A method for installing a column to structure attachment device according to claim 4 wherein said step of securing said means for maintaining compressive loading on said second end adapter element to create an axial compressive loading on said column between said first end adapter element and said second end adapter element further includes truncating said means for maintaining compressive loading attachment to said second end adapter to be within said void.

* * * * *